US006767597B2

(12) United States Patent
Onishi et al.

(10) Patent No.: US 6,767,597 B2
(45) Date of Patent: Jul. 27, 2004

(54) INK JET RECORDING MEDIUM

(75) Inventors: Hiroyuki Onishi, Nagano (JP); Hiroki Midorikawa, Tokyo (JP); Teiichi Otani, Tokyo (JP); Norihumi Tanaka, Tokyo (JP)

(73) Assignees: Seiko Epson Corporation, Tokyo (JP); Nippon Paper Industries Co., Ltd., Tokyo (JP)

( * ) Notice: Subject to any disclaimer, the term of this patent is extended or adjusted under 35 U.S.C. 154(b) by 317 days.

(21) Appl. No.: 09/725,639

(22) Filed: Nov. 29, 2000

(65) Prior Publication Data

US 2001/0015745 A1 Aug. 23, 2001

(30) Foreign Application Priority Data

Nov. 30, 1999 (JP) ..... P. 11-338971

(51) Int. Cl.[7] ..... B41M 5/40

(52) U.S. Cl. ..... 428/32.24; 347/105; 428/32.25; 428/32.31

(58) Field of Search ..... 428/195, 323, 428/502, 212, 213, 32.24, 32.31, 32.25

(56) References Cited

U.S. PATENT DOCUMENTS

| | | | | |
|---|---|---|---|---|
| 5,683,855 A | * | 11/1997 | Shinkai et al. | 430/270.11 |
| 6,040,035 A | * | 3/2000 | Satoh et al. | 428/195 |
| 6,165,606 A | * | 12/2000 | Kasahara et al. | 428/323 |

FOREIGN PATENT DOCUMENTS

| | | | | |
|---|---|---|---|---|
| EP | 0621510 | | 10/1994 | |
| EP | 0734882 | | 10/1996 | |
| EP | 0791474 | | 8/1997 | |
| EP | 0822094 | | 2/1998 | |
| EP | 0947349 | | 10/1999 | |
| JP | 529074 | | 1/1977 | |
| JP | 5551583 | | 4/1980 | |
| JP | 5872495 | | 4/1983 | |
| JP | 6339373 | | 2/1988 | |
| JP | 09-234947 | * | 9/1997 | B41M/5/00 |
| JP | 10-166713 | * | 6/1998 | B41M/5/00 |

* cited by examiner

*Primary Examiner*—B. Hamilton Hess
(74) *Attorney, Agent, or Firm*—Ladas & Parry

(57) ABSTRACT

An ink jet recording medium is provided which can be excellent in the ink-absorbing property, showing a high coloring property of images, and capable of printing images of a high image quality without causing color unevenness even by bidirectional printing using a high-resolution printer. An ink jet recording medium in the case of carrying out bidirectional printing using a printer of a serial system wherein inks of at least two colors are mounted in carriages and the nozzle row is disposed in parallel with the main scanning direction of a head, wherein the recording medium comprises a base material and an ink-receiving layer, the ink-receiving layer has an average ink-absorbing capacity of from 10 to 30 cc/cm$^2$, and the contact angle of the uppermost surface layer of the ink-receiving layer is from 20 to 60 degree to an ink having a surface tension of from 25 to 72 dyn/cm, is also provided.

12 Claims, 1 Drawing Sheet

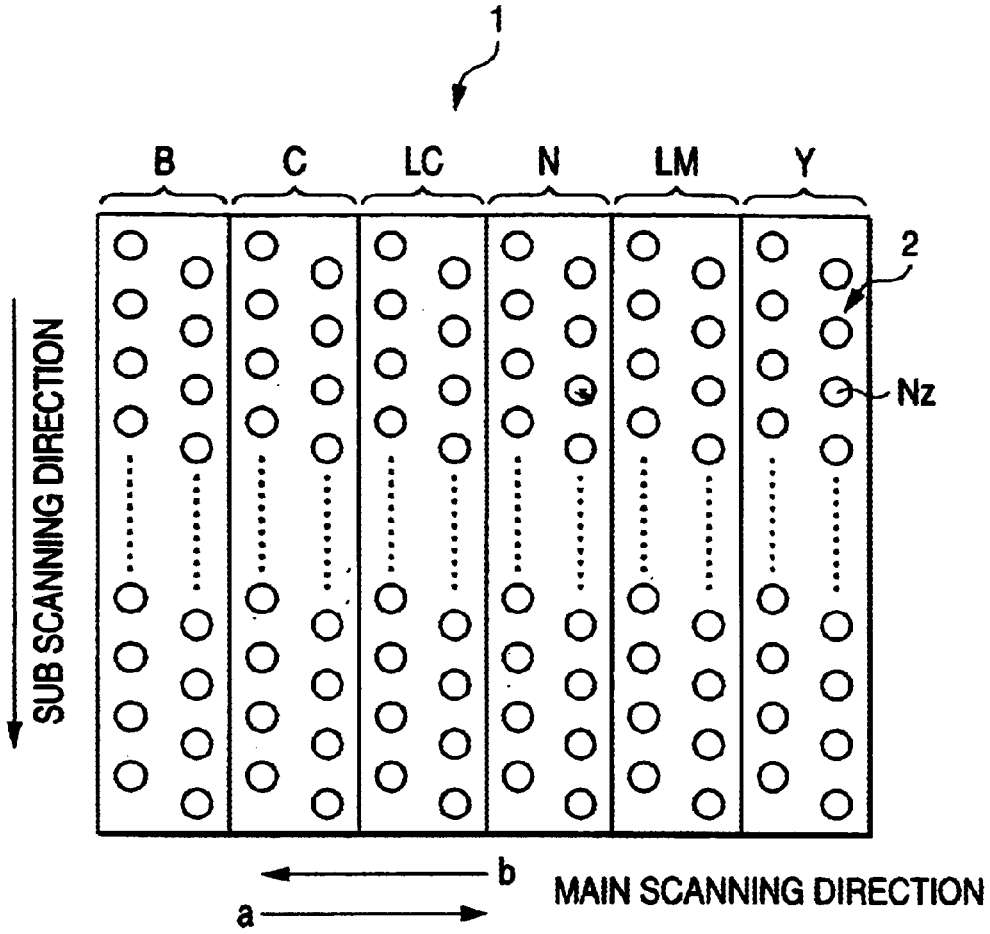
1
B
C
LC
N
LM
Y
2
Nz
SUB SCANNING DIRECTION
b
a
MAIN SCANNING DIRECTION

INK JET RECORDING MEDIUM

FIELD OF THE INVENTION

The present invention relates to a recording medium, and particularly to an ink jet recording medium suitable for using in the case of carrying out bidirectional printing using a printer of a serial system.

BACKGROUND OF THE INVENTION

In recent printers, increasing the high resolution proceeds and there is a tendency to increase the directing amount of ink per unit area. Particularly, in the image region of an intermediate tone, because a large amount of light-color ink such as a photo ink, etc., is used for reducing a particular feeling, the directing amount of ink per unit area is increased. Thus, as a recording medium used for these printers, a recording medium having a good absorption (large absorbing capacity) has been desired.

For realizing high-resolution printing, it is necessary to increase the density of nozzles and increase the frequency for jetting ink. Also, for realizing high-speed printing, it is necessary to carry out so-called bidirectional printing of jetting ink droplets at the forward path and backward path and increase the above-decried frequency for jetting ink. On the other hand, the printing speed depends upon the scanning speed of a head. (In addition, in the invention, "the scanning speed of head" means "the time until the head returns to the same position").

Accordingly, in a high resolution mode, by all means, the scanning speed becomes slow, and thus for increasing the printing speed, the necessity of printing from bidirections occurs.

In the bidirectional printing, the jetting order of inks becomes reverse between forwarding and backwarding, and thus, in bidirectional printing using parallel heads suitable for high speed printing, when the ink-absorbing capacity of the surface layer of an ink-receiving layer is small or the ink-absorbing speed is slow, in the case of printing mixed color images of, for example, red, blue, and green colors, coloring becomes different between the forward path and backward path. (In addition, in the invention, "the ink-absorbing speed" mean "the time until attaching an ink droplet to a surface to vanish the ink droplet from the surface").

For solving the problem in bidirectional printing, it is effective to improve the absorption of ink. For improving the absorption of ink, largely, the following two methods are considered.

One of them is a method of forming an ink-receiving layer containing a pigment having a large specific area, such as synthetic silica, etc., as the main constituent at a thickness of at least a definite layer thickness as disclosed in JP-A-52-9074, JP-A-58-72495, JP-A-55-51583, etc. (The term "JP-A" as used herein means an "unexamined published Japanese patent application".)

According to the above-described method of prior art, a high ink-absorption can be insured, but because inks permeate deeply, there are problems that the printing density is low and only images lacking in the clearness are obtained. Particularly, since the permeability of inks into a recording medium is increased for intending the reduction of the occurrence of bleeding between colors, in the recent full color printer of lowering the surface tension of inks, lowering of the printed density is remarkable.

In another method, the wetting property of the surface is improved as disclosed in JP-A-63-39373, etc.

In the method, when the directing amount of ink is small because the resolution in low, etc., the absorption is insured to some extent but when the resolution is high or a dense image is printed, and also when the directing amount of ink is large, there are problems that because essentially the absorbing amount of inks is insufficient, the inks overflow to bleed images and also because dots are large, only images lacking in sharpness are obtained.

On the other hand, when the ink absorbing speed is fast and the contact angle of inks to the surface of a recording medium is high, dots become small and inks permeate to height (depth) direction, whereby there are problems that coloring property is poor and only images inferior in the color reproducibility are obtained.

On the other hand, when the ink-absorbing speed is slow and the contact angle is low, dots are large, whereby there are problems that resolution becomes low, fine portions are broken, and letters, etc., become thick and bleed.

Also, when the ink-absorbing capacity of an ink-receiving layer is small or an ink-absorbing speed is slow, there is a problem that for example, in the case of expressing a green color with a yellow ink and a cyan ink, the case of printing cyan after printing yellow (forward path) and the case of printing yellow after printing cyan (backward path) give a different tone of green. This is caused that when in the state of remaining a first ink on the surface, the next ink is overlapped, the latter ink cannot stay on the surface layer and permeates into the ink-receiving layer deeper than the first ink.

In this case, when an image of at least twice the width (the printing width which can be printed by one scan) of a head, color unevenness (lateral stripes) occurs on the image, which becomes a problem.

As described above, until now, a recording medium, which does not cause color unevenness by printing at a high resolution mode and bidirectional printing for high-speed printing in the case of printing by a full color printer, and also is excellent in the high image quality (high resolution) and in coloring, cannot be provided.

The present invention has been made in view of the above-described problems, and an object of the invention is to provide an ink jet recording medium which is excellent in the ink absorption, gives a high coloring property of images, does not cause color unevenness and can print images of a high image quality even by bidirectional printing by a high-resolution printer.

SUMMARY OF THE INVENTION

As the result of investigations about the relation of the image quality of recorded images and the ink-absorbing capacity of an ink-receiving layer in a recording medium, the wetting property of inks to an ink-receiving layer, the absorption speed of inks into an ink-receiving layer, the scanning speed of head, etc., the present inventors have discovered that when a recording medium, wherein the ink-receiving layer has a specific ink-absorbing capacity and the contact angle of ink to the surface of the ink-receiving layer has a specific value, is used, images having a high image quality are obtained and have accomplished the present invention.

That is, the gist (first embodiment) of the ink jet recording medium of the present invention is an ink jet recording medium in the case of carrying out bidirectional printing using a printer of a serial system wherein inks of at least two colors are mounted in carriages and the nozzle row is disposed in parallel with the main scanning direction of a head, wherein the recording medium comprises a base material and an ink-receiving layer, the ink-receiving layer has an average ink-absorbing capacity of from 10 to 30 $cc/m^2$, and the contact angle of the uppermost surface layer of the ink-receiving layer is from 20 to 60 degree to an ink having a surface tension of from 25 to 72 dyn/cm, whereby the ink jet recording medium as the object of the invention can be provided.

Also, in the ink jet recording medium of the invention as the second embodiment, the ink-receiving layer is composed of at least two layers (that is, comprising at least two layers constituted of an upper layer forming the uppermost surface layer and at least one lower layer) and the ink absorbing capacity of the uppermost surface layer is larger than the ink-absorbing capacity of the lower layer.

Also, in the ink jet recording medium of the invention as the third embodiment, the ink absorbing speed of the uppermost surface layer of the ink-receiving layer is faster than the scanning speed of the head.

Furthermore, in the ink jet recording medium of the invention as the fourth embodiment, when the thickness of the uppermost surface layer is "A ($\mu$m)", the average ink absorbing capacity of the uppermost surface layer is "La ($cc/m^2$)", the thickness of the whole layers of the ink-receiving layer is "T ($\mu$m)", and the average ink absorbing capacity of the whole layers of the ink-receiving layer is "L ($cc/m^2$), the following relations of equation (1) and equation (2) are satisfied:

$$5\ \mu m < A < 0.7T \quad \text{Equation (1)}$$

$$1.1 \times L < La < 2 \times L \quad \text{Equation (2),}$$

whereby an ink jet recording medium which can print images of a high image quality without causing color unevenness even by, particularly, bidirectional printing using a high-resolution printer can be provided.

Moreover, in the ink jet recording medium of the invention as the fifth embodiment, the ink-receiving layer contains a pigment, and the pigment has an apparent specific volume of from 3 to 20 $cm^3/g$ and is at least one selected from synthetic silica, aluminum hydroxide, alumina, boehmite, calcium carbonate, aluminum silicate, magnesium carbonate, zeolite, and zinc oxide.

In the ink jet recording medium of the invention as the sixth embodiment, the ink-receiving layer comprises a coated layer containing a pigment for absorbing an ink and a binder in an amount of from 20 to 80 parts to 100 parts of the pigment, and the coated amount of the coated layer is from 10 to 30 $g/m^2$, whereby the ink-receiving layer having an average ink-absorbing capacity of from 10 to 30 $cc/m^2$ can be provided.

Also, in the ink jet recording medium of the invention as the seventh embodiment, the uppermost surface layer contains a cationic sizing agent in an amount of from 0.2 to 8 parts to 100 parts of the pigment for absorbing an ink.

In the ink jet recording medium of the invention as the eighth embodiment, the above-described uppermost surface layer is formed by overcoating a layer containing from 0.2 to 3 parts of a cationic sizing agent.

Also, in the ink jet recording medium of the invention as the ninth embodiment, the cationic sizing agent is made of a styrene-base resin, whereby the contact angle of the uppermost surface layer of the ink-receiving layer can be set to from 20 to 60 degree to an ink having a surface tension of from 25 to 72 dyn/cm, and also the ink jet recording medium, wherein the ink-absorbing capacity of the uppermost surface layer is larger than the ink-absorbing capacity of the lower layer, can be provided.

Also, the ink jet recording medium of the invention is used for a recording method wherein the resolution is at least 720×720 dpi as the tenth embodiment and is also used for a recording method that the maximum jetting amount of ink per one dot is not larger than 15 picoliters (pl) as the eleventh embodiment.

Even in the recording methods of such a resolution and the maximum jetting amount of ink, images of a high image quality can be printed without causing color unevenness.

BRIEF DESCRIPTION OF THE DRAWING

The FIGURE is a view for explaining "the printer for carrying out bidirectional printing" and is a plain view of a printing head (seen from a recording medium side) of the printer.

DETAILED DESCRIPTION OF THE INVENTION

Then, the mode for carrying the invention is explained, but before the explanation, "a printer carrying out bidirectional printing" used in the invention is described based on FIG. 1.

A head 1 of FIG. 1 has nozzle rows 2 equipped with nozzles Nz for jetting inks of colors of yellow Y, light magenta LM, magenta M, light cyan LC, cyan C, and black B from the right. The nozzle rows 2 are disposed in parallel with the main scanning direction of the head 1. Also, the printer (not shown) makes "a bidirectional printing action" of carrying out printing in both actions of the reciprocating motion of the main scanning direction (in FIG. 1, the direction of the direction of an arrow a and the direction of an arrow b). In addition, a recording medium (not shown) moves to a sub scanning direction crossing at right angle to the main scanning direction.

As described above, the present invention is an ink jet recording medium characterized in that the uppermost surface layer of the ink-receiving layer has an ink-absorbing capacity of from 10 to 30 $cc/m^2$ per unit area, and the contact angle of the uppermost surface layer of the ink-receiving layer is from 20 to 60 degree to an ink having a surface tension of from 25 to 75 dyn/cm.

The ink jet recording medium of the invention comprises a base material and an ink-receiving layer formed on the base material and, if necessary, a ultraviolet ray-absorbing layer, a gloss layer, etc., can be further formed an the ink-receiving layer but in this case, the ultraviolet ray-absorbing layer, the gloss layer, etc., must have a sufficient ink permeability (have a larger ink permeability than that of the uppermost surface layer).

Also, it is preferred that the ink-receiving layer itself is composed of at least two layer, that is, at least two layers composed of one upper layer forming the uppermost surface layer and at least one lower layer and the ink-absorbing capacity of the uppermost surface layer is larger than the ink-absorbing capacity of the lower layer(s).

As the base material in the invention, base materials which are hitherto been known, such as plain papers, synthetic papers, plastic films, etc., can be used.

A paper as the base material is a sheet containing a fibrous material and, if necessary, a filler, and papers manufactured by an acidic paper-making method and a neutral paper-making method, which have hitherto been known, can be used.

The above-described fibrous material constituting the paper is mainly a wood pulp such as LBKP and NBKP and, if necessary, the paper may contain various synthetic fibers, glass fibers, etc.

As the plastic film as the base material, known transparent films and opaque films are used. As the material of the plastic film, a polyester-base resin, a triacetate-base resin, an acrylic resin, a polycarbonate-base resin, a polyimide-base resin, a polyurethane-base resin, an epoxy resin, cellophane, celluloid, etc., which have hitherto been known, are used.

The ink-receiving layer in the invention is constituted of at least one layer including the uppermost surface layer made of a binder and a pigment for absorbing inks (hereinafter, is sometimes referred as simply "pigment") as the main constituents, wherein the average ink-absorbing capacity per unit area is from 10 to 30 cc/$m^2$, and the contact angle of the uppermost surface layer of the ink-receiving layer is from 20 to 60 degree to an ink having a surface tension of from 25 to 72 dyn/cm.

The ink-receiving layer can contain, if necessary, various additives such as a sizing agent, a fluorescent brightening agent, a surface active agent, a defoaming agent, a pH-controlling agent, a mildewproof agent, a ultraviolet absorbent, an antioxidant, etc., in the extent of not reducing the effects of the invention. The additives may be mixed with the coating liquid for the ink-receiving layer (so-called internal addition) or may be coated after forming the ink-receiving layer.

In a preferred mode for carrying out the invention, a pigment having an apparent specific volume of from 3 to 20 $cm^3$/g is used, and by forming a coated layer, wherein the compounding amount of the binder is in the range of from 20 to 80 parts by weight to 100 parts by weight of the pigment at from 10 to 30 g/$m^2$, the ink-receiving layer having an average ink-absorbing capacity of from 10 to 30 cc/$m^2$ can be formed. Further, the "apparent specific volume" as used herein is measured by a "piston process" disclosed in JIS K 6220, "6.8 Apparent Specific Gravity".

Also, by adding a cationic sizing agent to the uppermost surface layer in an amount of from 0.2 to 8 part by weight to 100 parts by weight of a pigment having an apparent specific volume of from 3 to 20 $cm^3$/g or by overcoating a layer containing from 0.2 to 3 g/$m^2$, the contact angle of the uppermost layer can be set to from 20 to 60 degree.

When the average ink-absorbing capacity per unit area is less than 10 cc/$m^2$, the ink-absorbing capacity is insufficient and an ink overflows to cause bleeding on letters and images, which is undesirable. Also, when the average ink-absorbing capacity exceeds 30 cc/$m^2$, an ink permeates too deeply, whereby the reflection density is wholly low such as the dot size is small, images wherein solid black portions are completely filled are not obtained, etc., and the images formed become thin images, which are also undesirable.

On the other hand, when the contact angle of the uppermost surface layer of the ink-receiving layer is less than 20 degree to an ink having a surface tension of from 25 to 72 dyn/cm, the ink permeates fast to the plane direction, which results in that the dot size becomes large and the letters, etc., become thick, and thus images formed become images lacking in sharpness (blurred), and in the other hand, when the contact angle exceeds 60 degree, the drying property of ink becomes slow, unevenness occurs in bidirectional printing, and in an extreme case, rolls of the conveying system are sometimes stained, which are undesirable.

In the invention, as the binder, polyvinyl alcohol derivatives such as polyvinyl alcohol, etc., proteins such as casein, gelatin, soybean proteins etc.; starch derivatives such an oxidized starch, phosphoric acid esterificated starch, etherificated starch, etc.; cellulose derivatives such as carboxymethyl cellulose, hydroxyethyl cellulose, etc.; various latexes such as a styrene-butadiene copolymer, the polymer or copolymer of an acrylic acid ester and a methacrylic acid ester, an ethylene-vinyl acetate copolymer, and etc.; and polyurethane resin; etc., can be used. In particular, the use of polymers having a high hydrophilic property, such as polyvinyl alcohol, etc., is preferred.

Also, as a pigment for absorbing an ink, synthetic silica, aluminum hydroxide, alumina, pseudo boehmite, calcium carbonate, aluminum silicate, magnesium carbonate, zeolite, zinc oxide, etc., can be used.

The specific surface of the pigment for absorbing ink is preferably from 50 to 600 $m^2$/g, and more preferably from 100 to 350 $m^2$/g.

When the specific surface of the above-described pigment is less than 50 $m^2$/g, because the ink-absorbing capacity per unit area is low, the ink-absorbing speed becomes slow and bleeding occurs. On the other hand, when the specific surface exceeds 600 $m^2$/g, the ink absorption becomes good but the binder is also absorbed, which results in weakening the surface strength and easily causing powder falling, which are undesirable.

The addition amount of the binder to the pigment for absorbing ink is preferably from 10 to 100 parts by weight, more preferably from 20 to 80 parts by weight, and most preferably from 15 to 60 parts by weight to 100 parts by weight of the pigment.

When the addition amount of the binder to 100 parts by weight of the pigment is less than 10 parts by weight, the adhesion of the pigment is insufficient to cause powder falling, and on the other hand, when the addition amount exceeds 100 parts by weight, the void of the pigments is reduced, which results in inferior the ink absorption (capacity and speed) to undesirably cause bleeding.

Furthermore, as the cationic sizing agent, cationic sizing agents of a styrene resin-base, an alkyl dimer-base (Size Pine K-902, etc., manufactured by ARAKAWA CHEMICAL INDUSTRIES, LTD.), a higher fatty acid-base (NS-815, etc., manufactured by Kindai Kagaku K. K.), a petroleum resin-base (H-7A, etc., manufactured by Kindai Kagaku K. K.), a styrene-acrylic synthetic resin-base (Pearl Gum CS-25S, etc.), etc., can be used, but the use of the styrene resin-base cationic sizing agent is preferred.

The addition amount of the sizing agent in the uppermost surface layer is, as described above, preferably from 0.2 to 8 parts by weight, and more preferably from 0.5 to 5 parts by weight to 100 parts by weight of the pigment for absorbing ink. When the addition amount of the sizing agent is less than 0.2 part by weight, the contact angle becomes small and, on the other hand, the addition amount exceeds 8 parts by weight, the contact angle becomes large, which are undesirable.

Also, it is preferred that the absorption speed of ink of the ink-receiving layer in the invention is faster than the scanning speed of head. The purpose is attained by imparting, for example, following both properties to the uppermost layer;

(1) the property of absorbing ink fast in mainly the perpendicular direction by forming a layer properly compounded with a binder by the formulation containing a pigment having a large ink-absorbing capacity as the main subject on the uppermost surface layer at a thickness of at least a definite layer thickness, and (2) the property of absorbing ink mainly onto the plain direction by greatly increasing wetting property by compounding or coating a surface active agent of at least a definite amount with or on the uppermost surface layer.

Also, it is preferred that in the ink-receiving layer in the invention, when the thickness of the uppermost surface layer is "A (μm)", the average ink absorbing capacity of the uppermost surface layer is "La (cc/m$^2$)", the thickness of the whole layers of the ink-receiving layer is "T (μm)", and the average ink absorbing capacity of the whole layers of the ink-receiving layer is "L (cc/m$^2$), the following relations of equation (1) and equation (2) are satisfied:

$$5\ \mu m < A < 0.7T \quad \text{Equation (1)}$$

$$1.1 \times L < La < 2 \times L \quad \text{Equation (2).}$$

When the thickness A is "thinner than 5 μm", the ink-absorbing capacity is insufficient, while the thickness A is thicker than "0.7T", the ink absorption is too good, whereby the dot size becomes small and the apparent printing density is lowered.

Also, when La is "lower than 1.1 L", the ink-absorbing speed of a lower layer becomes faster, as the case of coating in a large amount by single layer, the dot is not extended but is permeated into the depth direction, which results in lowering the print density. Also, when La is larger than "2×L", bulks exist and the layer bas a porous structure, whereby the strength of the coated layer is weak to cause powder falling.

The ink-receiving layer wherein the above-described relation is satisfied is obtained, for example, as follows That is the ink-receiving layer is obtained by coating a coating liquid formed by adding 50 parts by weight of a binder to 100 parts by weight of a pigment having an apparent specific volume of 5 cm$^3$/g as a 1st layer (lower layer) at 10 g/m$^2$, coating thereon a coating liquid formed by adding 40 parts by weight of a binder to 100 parts by weight of a pigment having an apparent specific volume of 10 cm$^3$/g as a 2nd layer (upper layer) at 6 g/m$^2$, and then coating thereon a cationic sizing agent at 0.5 g/m$^2$ to form the uppermost surface layer, or the ink-receiving layer is obtained by coating on the above-described 1st layer (lower layer) a coating liquid for the above-described 2nd layer (upper layer) added with 1.5 parts by weight of a cationic sizing agent to form the uppermost surface layer.

Then, the inks used in the case of printing on the ink jet recording medium of the invention are descried in detail but the invention is not limited to the inks described below.

In the invention, as ink coloring agents, inorganic pigments or organic pigments can be optionally used. In these pigments, as the inorganic pigment, for example, in addition to titanium oxide and iron oxide, carbon black produced by a known method, such as a contact method, a furnace method, a thermal method, etc., can be used.

As the organic pigment, azo dyes (including azo lakes, insoluble azo pigments, condensed azo pigments, chelate azo pigments, etc.), polycyclic pigments (a phthalocyanine pigment, a perylene pigment, a perynone pigment, an anthraquinone pigment, a quinacridone pigment, dioxasinc pigment, thioindigo pigment, isoindolinone pigment, quinofuralone pigment, etc.), nitro pigments, nitroso pigments, aniline black, etc., can be used.

In the case of using the inorganic pigment or the organic pigment described above, the addition amount of the pigment to the ink is preferably from about 0.5 to 25% by weight, and more preferably from 2 to 15% by weight As the ink colorants, in addition to the above-described inorganic pigments and organic pigments, water-soluble dyes can be used, such as direct dyes, acid dyes, edible dyes, basic dyes, reactive dyes, and disperse dyes. As the particularly preferred dyes, there are, "C. I. Direct Red 2, 4, 9, 23, 26, 31, 39, 62, 63, 72, 75, 76, 79, 80, 81, 83, 84, 89, 92, 95, 111, 173, 184, 207, 211, 212, 214, 218, 221, 223, 224, 225, 226, 227, 232, 233, 240, 241, 242, 243, 247", "C. I. Direct Violet 7, 9, 47, 48, 51, 66, 90, 93, 94, 95, 98, 100, 101", "C. I. Direct Yellow 8, 9, 11, 12, 27, 28, 29, 33, 35, 39, 41, 44, 50, 53, 58, 59, 68, 86, 87, 93, 95, 96, 98, 100, 106, 108, 109, 110, 130, 132, 142, 144, 161, 163", "C. I. Direct Blue 1, 10, 15, 22, 25, 55, 67, 68, 71, 76, 77, 79, 80, 84, 89, 87, 90, 98, 106, 109, 109, 151, 156, 158, 159, 160, 168, 189, 192, 193, 194, 199, 200, 201, 202, 203, 207, 211, 213, 214, 218, 225, 229, 236, 237, 244, 248, 251, 252, 264, 270, 290, 299, 299, 291", "C. I. Direct Black 9, 17, 19, 22, 32, 51, 56, 62, 69, 77, 80, 91, 94, 97, 109, 112, 113, 114, 117, 119, 121, 122, 125, 132, 146, 154, 166, 168, 173, 199", "C. I. Acid Red 35, 42, 52, 57, 62, 80, 82, 111, 114, 118, 119, 127, 129, 131, 143, 151, 154, 158, 249, 254, 257, 261, 263, 266, 289, 299, 301, 305, 326, 337, 361, 396, 397", "C. I. Acid Violet 5, 34, 43, 47, 48, 90, 103, 126", "C. I. Acid Yellow 17, 19, 23, 25, 39, 40, 42, 44, 49, 50, 61, 64, 76, 79, 110, 127, 135, 143, 151, 159, 174, 190, 195, 196, 197, 199, 218, 219, 222, 227", "C. I. Acid Blue 9, 25, 40, 41, 62, 72, 76, 78, 80, 82, 92, 106, 112, 113, 120, 127:1, 129, 138, 143, 175, 181, 205, 207, 220, 221, 230, 232, 247, 258, 260, 264, 271, 277, 278, 279, 280, 288, 290, 326", "C. I. Acid Black 7, 24, 29, 48, 52;1, 172", "C. I. Reactive Red 3, 13, 17, 19, 21, 22, 23, 24, 29, 35, 37, 40, 41, 43, 45, 49, 55", "C. I. Reactive Violet 1, 3, 4, 5, 6, 7, 8, 9, 16, 17, 22, 23, 24, 26, 27, 33, 34", "C. I. Reactive Yellow 2, 3, 13, 14, 15, 17, 19, 23, 24, 25, 26, 27, 29, 35, 37, 41, 42", "C. I. Reactive Blue 2, 3, 5, 8, 10, 13, 14, 15, 17, 18, 19, 21, 25, 26, 27, 29, 29, 39", "C. I. Reactive Black 4, 5, 8, 14, 21, 23, 26, 31, 32, 34"

"C. I. Basic Red 12, 13, 14, 15, 19, 22, 23, 24, 25, 27, 29, 35, 36, 38, 39, 45, 46", "C. I. Basic Violet 1, 2, 3, 7, 10, 15, 16, 20, 21, 26, 27, 28, 35, 37, 39, 40, 48", "C. I. Basic Yellow 1, 2, 4, 11, 13, 14, 15, 19, 21, 23, 24, 25, 28, 29, 32, 36, 39, 40", "C. I. Basic Blue 1, 3, 5, 7, 9, 22, 26, 41, 45, 46, 47, 54, 57, 60, 62, 65, 66, 69, 71", "C. I. Basic Black 8", etc.

The addition amounts of these water-soluble dyes are determined by the kind of the dye, the kind of the solvent components, the required characteristics, etc., but it is better that the addition amount is in the range of from 0.2 to 7% by weight, and preferably from 0.5 to 5% by weight to the whole weight of the ink.

Also, in the invention, as an additive, a wetting agent can be added to prevent the occurrence of clogging. As the wetting agent, high-boiling point low-volatile polyhydric alcohols such as glycerol, ethylene glycol, diethylene glycol, triethylene glycol, propylene glycol, dipropylene glycol, hexylene glycol, polyethylene glycol, polypropylene glycol, 1,3-propanediol, 1,5-pentanediol, etc., are used. As other examples, nitrogen-containing organic solvent such as N-methyl-2-pyrrolidone, 1,3-dimethylimidazolidinone, monoethanolamine, diethanolamine, triethanolamine, etc., and solid additives having a high hygroscopic additives, such as urea, sugar, etc., can be used. The addition amount is desirably from 4 to 30% by weight, and preferably from 7 to 20% by weight.

Also, it is preferred to use an acetylene glycol-base surface active agent, and the control of the surface tension of ink, the control of the wetting property of the recording medium, and the impart of a permeability to the recording medium can be surely carried out. Preferred examples of the acetylene glycol-base surface active agent are those shown by the following formula:

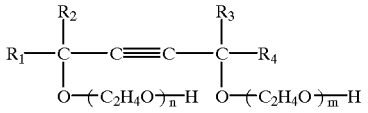

wherein $R_1$, $R_2$, $R_3$, and $R_4$ each independently represents an alkyl group and n+m is from 0 to 30.

As practical examples thereof, there are Surfynol TG, Surfynol 420, Surfynol 440, and Surfynol 465 (all, manufactured by Air Products Co.). The addition amount of such a permeating agent to a recording ink for ink jet is preferably from 0.1 to 5% by weight, and more preferably from 0.5 to 3% by weight.

As other additives, water-soluble organic solvents, various dispersing agents, viscosity-controlling agents, fluorescent brightening agents, etc., which have hitherto been known, can be, if necessary, added. Examples of them are shown below.

Alkyl alcohols having from 1 to 4 carbon atoms, such as methanol, ethanol, propanol, etc., can be used as the organic solvent, and also water-soluble natural or synthetic polymers such as celluloses, polyvinylpyrrolidone, polyvinyl alcohol, water-soluble resins, etc., can be used as the viscosity-controlling agent. Furthermore, a pH-controlling agent by a buffer solution can be added.

Also, for preparing a recording liquid used for a ink jet recording method of the type of electrostatically charging the recording liquid, a specific resistance-controlling agent such as inorganic salts (e.g., lithium chloride, ammonium chloride, and sodium chloride) can be added.

In addition, in the case of applying an ink jet recording system of jetting a recording liquid by the action of heat energy, as the case may be, the thermal properties (evaporation heat, boiling point, melting point, specific heat, thermal expansion coefficient, thermal conductivity, etc.) are controlled.

The ink for ink jet recording used in the invention can be prepared by mixing and dissolving various components as described above and removing impurities, etc., by filtration.

Also, as the properties of the ink, for assuring the stable jetting from a head and stable supplying of ink to the heat, it is better that the viscosity is not more than 50 mPa's and more preferably not more than 20 mPa's.

The ink jet recording medium of the invention preferably provides an ink jet recording medium used for a recording method wherein the resolution is higher than 720×720 dpi or an ink jet recording medium used for a recording method wherein the maximum jetting amount of ink per one dot is not more than 25 pl, and in the recording methods of such a resolution and the maximum jetting amount of ink, images of a high image quality can be printed without causing color unevenness. For example, as is clear from "the test method" shown in the example described later, even by carrying out bidirectional printing using "a printer PM-770C (trade name) manufactured by Seiko Epson Corporation", wherein the resolution is 720×720 dpi, and the maximum jetting amount of ink per one dot is 13 pl, images of a high quality can be printed without causing color unevenness.

EXAMPLES

Then, the present invention is practically explained by referring to the examples of the invention and comparative examples, but the invention is not limited to the following examples. Unless otherwise indicated herein, all the parts, percents, and ratios are by weight.

Example 1

Preparation of Base Paper

To a mixture of 85 parts of LBKP and 15 parts of NBKP as pulps were added 0.5 part of rosin sizing agent, 15 parts of talc, 1 part of aluminum sulfate, and proper amounts of a yield improving agent and a defoaming agent, and by a Fourdrinier paper machine, a base paper having water content of 6% was obtained.

Formation of Ink-Receiving Layer

Lower Layer

| | |
|---|---|
| Precipitation method silica: Mizukasil P-526 (apparent specific volume: 12 $cm^3/g$) (manufactured by Mizusawa Industrial Chemicals, Ltd.) | 50 parts |
| Gel method silica: Sailoid 621 (apparent specific volume: 5 $cm^3/g$) (manufactured by Grace Chemicals, Co. Ltd.) | 50 parts |
| Binder: PVA117 (manufactured by KURARAY CO., LTD.) | 50 Parts |
| Dye-fixing agent: JK173 (manufactured by Meisei Kagaku Kogyo K.K.) | 10 parts |

A slurry made of the above-described components was prepared such that the solid components became 20% to form a coating liquid for the lower layer. The lower layer coating liquid was coated at 10 $g/m^2$ by a bar blade (lower layer information).

Uppermost Layer

| | |
|---|---|
| Precipitation method silica: Finesil X-378 (apparent specific volume: 6.9 $cm^3/g$) (manufactured by Tokuyama Corp.) | 100 parts |
| Binder: PVA117 (manufactured by Kuraray Co., Ltd.) | 40 Parts |
| Dye-fixing agent: JK173 (manufactured by Meisei Kagaku Kogyo K.K.) | 12 parts |

A slurry made of the above-components was prepared such that the solid components became 17% to form a coating liquid for upper layer. The upper layer coating liquid was coated on the above-described lower layer at 0.5 $g/m^2$ by a bar blade (upper layer formation).

Furthermore, Polymaron 380 (manufactured by Arakawa Chemical Industries, Ltd.), which was a styrene resin-base cationic sizing agent was coated on the above-described upper layer by a bar blade at 0.5 $g/m^2$ and dried until the water content became 4.5% to form the uppermost layer, and then a surface treatment was applied thereto by a soft calender apparatus at the condition of a line pressure of 120 $kg/cm^2$ to obtain an ink jet coated paper.

The average ink absorbing capacity (L) of the paper was 18 $cc/m^2$, and the contact angle to a ink having a surface tension of 33 dyn/cm was 50%. and

Example 2

By following the same procedure as Example 1 except that the uppermost layer in the Example 1 was omitted, to the coating liquid in the upper layer in Example 1 was added 0.8 part of the styrene resin-base cationic sizing agent was added, and the layer formed by coating the coating liquid on the lower layer at 8 g/m$^2$ was used as the uppermost layer, an ink jet coated paper was prepared.

The average ink-absorbing capacity (L) of the paper was 22 cc/m$^2$ and the contact angle of the ink having a surface tension of 33 dyn/cm was 35°.

Example 3

By following the same procedure as Example 1 except that the uppermost layer in the Example 1 was omitted, to the coating liquid in the upper layer in Example 1 was added 3 parts of the styrene resin-base cationic sizing agent was added, and the layer formed by coating the coating liquid on the lower layer at 8 g/m$^2$ was used as the uppermost layer, an ink jet coated paper was prepared.

The average ink-absorbing capacity (L) of the paper was 22 cc/m$^2$ and the contact angle of the ink having a surface tension of 33 dyn/cm was 35°.

Comparative Example 1

By following the game procedure as Example 1 except that the above-described coated layer for the lower layer in Example 1 was used for the lower layer and the upper layer and the uppermost layer in Example 1 was not formed, an ink jet paper was prepared.

The average ink-absorbing capacity (L) of the paper was 15 cc/m$^2$ and the contact angle of the ink having a surface tension of 33 dyn/cm was 65°.

Comparative Example 2

As an ink-receiving layer, using the coating liquid for the lower layer in Example 1 except that 100 parts of gel method silica Mizukasil p-50 (apparent specific volume: 3.9 cm$^3$/g, manufactured by Mizusawa Industrial Chemicals, Ltd.) was compounded with 120 parts of a binder, PVA117, the coated liquid was coated by a bar blade at 8 g/m$^2$.

On the layer, a styrene resin-base cationic sizing resin, which was a cationic sizing agent, was coated as the uppermost layer at 3 g/m$^2$ to obtained an ink jet coated paper.

The average ink-absorbing capacity (L) of the paper was 8 cc/m$^2$ and the contact angle of the ink having a surface tension of 33 dyn/cm was 70°.

Comparative Example 3

By following the same procedure as Example 1 except that the styrene resin-base cationic sizing agent, which was a cationic sizing agent, was coated at 5 g/m$^2$, an ink jet coated paper was obtained.

The average ink-absorbing capacity (L) of the paper was 20 cc/m$^2$ and the contact angle of the ink having a surface tension of 33 dyn/cm was 75°. and Comparative Example 4

By following the same procedure as Example 1 except that Emulgen 707 (manufactured by Kao Corporation), which was a surface active agent, was overcoated at 1 g/m$^2$, and ink jet coated paper was obtained.

The average ink-absorbing capacity (L) of the paper was 20 cc/m$^2$ and the contact angle of the ink having a surface tension of 33 dyn/cm was 5°.

About each of the ink jet coated papers obtained Examples 1 to 3 and Comparative Examples 1 to 4 descried above, the tests of bidirectional printing, the resolution, the image quality, and the coloring property are carried out, and the results are shown in Table 1.

TABLE 1

| | Absorbing capacity (cc/cm$^2$) | | Contact | Film thickness (μm) | | Bidirec- | Resolution | | |
|---|---|---|---|---|---|---|---|---|---|
| | Uppermost layer La | Whole L | angle (degree) | Uppermost layer A | Whole T | tional printing | (line width) | Image quality | Coloring property |
| Example 1 | 21 | 18 | 50 | 12 | 30 | ○ | ○ | ○ | ○ |
| Example 2 | 25 | 22 | 35 | 14 | 33 | ○ | ○ | ○ | ○ |
| Example 3 | 26 | 22 | 35 | 14 | 33 | ○ | ○ | ○ | ○ |
| Comparative Example 1 | 18 | 15 | 65 | 10 | 22 | Δ | ○ | ○ | X |
| Comparative Example 2 | 11 | 8 | 70 | 2 | 15 | X | ○ | X | ○ |
| Comparative Example 3 | 23 | 20 | 75 | 12 | 31 | X | ◎ | Δ | ○Δ |
| Comparative Example 4 | 23 | 20 | 5 | 12 | 32 | ○ | X | Δ | Δ |

Measurement Method

Measurement Method of Ink-Absorbing Capacity:

Using dynamic permeability test machine (commonly called "Pristor test machine" manufactured by Toyo Seiki Seisaku-sho, Ltd., and using a BK ink for a printer PM-700C manufactured by Seiko Epson Corporation, about each sample, the liquid transition amounts (cc/m$^2$) of three points of √ t=0.1 sec., 0.2 sec., and 0.3 sec., were measured and the average of the three points was obtained by calculating and employed as an ink-absorbing capacity.

Measurement Method of Contact Angle:

By a Face automatic contact meter Type CA-2 manufactured by Kyowa Kaimen Kagaku K. K., using a BK ink for a printer PM-700C, the contact angle after 0.03 sec. was measured.

Bidirectional Printing:

Using a printer PM-770C manufactured by Seiko Epson Corporation, printing was carried out at a super fine mode under the condition of bidirectional. As an image, "N1" published by Japanese Industrial Standard Society was used, and as a soft, Photoshop® of Adobe Systems Incorporated, was used. Evaluation was visually carried out.

○ No unevenness.

Δ Unevenness is observed a little.

x Unevenness a greatly observed.

Resolution (Line Width):

Using a printer PM-770C manufactured by Seiko Epson Corporation, a head-clogging confirmed pattern was magnified 100 times after printing, the average diameter was calculated, and evaluated as follows.

⊙ less than 50 μm

○ 50 to 70 μm

Δ 71 to 90 μm x exceeding 90 μm

Image quality;

A black letter image was formed on solid yellow by Microsoft's Excel, the image was printed using a printer PM-770C manufactured by Seiko Epson Corporation, at a super fine paper/photo mode, and the printed image was evaluated as follows.

○ No bleeding of letter.

ΔBleeding is observed a little.

x Remarkable bleeding is observed.

Coloring Property:

Solid images of black, cyan, magenta, and yellow were formed by Microsoft's Excel, each image was printed using a printer PM-770C manufactured by Seiko Epson Corporation at a super fine paper/photo mode, the densities of 4 color prints were measured by a Macbeth (RD 914) densitometer and evaluated as follows.

○ Sum total densities of 4 colors exceed 6.4.

○Δ Sum total densities of 4 colors are 5.8 to 6.4.

Δ Sum total densities of 4 colors are 5.2 to 5.7.

x Sum total densities of 4 colors are lower than 5.2.

From the above-described results, it is clear that the recorded ones using the ink jet recording media of the present invention show excellent effects in all the points of the bidirectional printing, resolution, image quality, and coloring property.

As described above in detail, according to the invention, by forming an ink-receiving layer having an average ink-absorbing capacity of from 10 to 30 cc/m$^2$ on a base material and setting the contact angle of the uppermost surface layer of the ink-receiving layer to from 20 to 60 degree to an ink having a surface tension of from 25 to 72 dyn/cm, the excellent effects that in the ink-absorbing property is excellent, the coloring property of images formed is high, and images of a high image quality can be printed without causing color unevenness even by bidirectionally printing by a high resolution printer are obtained.

While the invention has been described in detail and with reference to specific embodiments thereof, it will be apparent to one skilled in the art that various changes and modifications can be made therein without departing from the spirit and scope thereof.

This application is based on Japanese patent application No. Hei-11-338971 filed on Nov. 30, 1999, the entire contents of which incorporated herein by reference.

What is claimed is:

1. An ink jet recording medium for carrying out bidirectional printing using a printer of a serial system wherein inks of at least two colors are mounted in carriages and the nozzle row is disposed in parallel with the main scanning direction of a head, wherein the recording medium comprises a base material and an ink-receiving layer, the ink-receiving layer comprising a plurality of layers including at least a first lower layer and an uppermost surface layer, wherein the uppermost surface layer has an average ink-absorbing capacity of from 10 to 30 cc/m$^2$, and the contact angle of the uppermost surface layer of the ink-receiving layer is from 20 to 60 degree to an ink having a surface tension of from 25 to 72 dyn/cm, wherein the thickness of the uppermost surface layer is "A (μm)", the average ink absorbing capacity of the uppermost surface layer is "La (cc/m$^2$)", the thickness of the plurality of layers of the ink-receiving layer is "T (μm)", the average ink absorbing capacity of the plurality of layers of the ink-receiving layer is "L (cc/m$^2$), and the following relations of equation (1) and equation (2) are satisfied:

$$5\ \mu m < A < 0.7T \qquad \text{Equation (1)}$$

$$1.1 \times L < La < 2 \times L \qquad \text{Equation (2).}$$

2. The ink jet recording medium according to claim 1, wherein the ink-receiving layer contains a pigment, and the pigment has an apparent specific volume of from 3 to 20 cm$^3$/g and is at least one selected from synthetic silica, aluminum hydroxide, alumina, pseudo boehmite, calcium carbonate, aluminum silicate, magnesium carbonate, zeolite, and zinc oxide.

3. The ink jet recording medium according claim 1, wherein the ink-receiving layer comprises a coated layer containing a pigment for absorbing an ink and a binder in an amount of from 20 to 80 parts by weight to 100 parts by weight of the pigment, and the coated amount of the coated layer is from 10 to 30 g/m$^2$.

4. The ink jet recording medium according to claim 1, wherein the uppermost surface layer contains a cationic sizing agent in an amount of from 0.2 to 8 parts by weight to 100 parts by weight of the pigment for absorbing an ink.

5. The ink jet recording medium according to claim 4, wherein the cationic sizing agent is made of a styrene-base resin.

6. The ink jet recording medium according to claim 1, wherein the uppermost surface layer is contains from 0.2 to 3 parts of a cationic sizing agent.

7. The ink jet recording medium according to claim 6, wherein the cationic sizing agent comprises a styrene-base resin.

8. An ink jet recording method comprising (a) providing the recording medium of claim 1;

(b) providing a printer comprising means for carrying out bidirectional printing for formation of print images on the recording medium, said means comprising a head, a plurality of carriages comprising inks of at least two colors and a nozzle row disposed in parallel with a main scanning direction of the head; and (c) carrying out the bidirectional printing with deposition of the inks of at least two colors onto the recording medium to form the print images thereon.

9. The ink jet recording method of claim 8, wherein the bidirectional printing in step (c) forms the print images with a resolution of at least 720×720 dpi.

10. An ink jet recording apparatus comprising:

(a) the ink jet recording medium of claim 1; and (b) a printer comprising means for carrying out bidirectional printing for formation of print images on the recording medium, said means comprising a head having a scanning speed, wherein the uppermost surface layer of the ink-receiving layer has an ink absorbing speed that is faster than the scanning speed of the head.

11. An ink jet recording method comprising:

(a) providing the recording medium of claim 1; and (b) forming a print image on the recording medium having a resolution of at least 720×720 dpi.

12. An ink jet recording method comprising:

(a) providing the recording medium of claim 1; and (b) depositing drops of an ink onto the recording medium for forming an image thereon, wherein a maximum jetting amount of ink per one dot is not larger than 15 picoliters.

* * * * *